US006813924B1

(12) United States Patent
Van Der Aa et al.

(10) Patent No.: US 6,813,924 B1
(45) Date of Patent: Nov. 9, 2004

(54) PROCESS FOR THE WALL IRONING OF A PRODUCT IN SHEET FORM, AND A WALL IRONING TOOL

(75) Inventors: Michiel Adrianus Henricus Van Der Aa, Veghel (NL); Hendrikus Christianus Engelbertus Van Der Aa, Haarlem (NL); Hendrik Bastiaan Ras, Heemskerk (NL); Willem Jan Van Veenen, Beverwijk (NL)

(73) Assignee: Corus Staal BV, Ca Ijmuiden (NL)

( * ) Notice: Subject to any disclaimer, the term of this patent is extended or adjusted under 35 U.S.C. 154(b) by 0 days.

(21) Appl. No.: 09/914,645

(22) PCT Filed: Mar. 2, 2000

(86) PCT No.: PCT/EP00/01950

§ 371 (c)(1),
(2), (4) Date: Nov. 19, 2001

(87) PCT Pub. No.: WO00/51758

PCT Pub. Date: Sep. 8, 2000

(30) Foreign Application Priority Data

Mar. 3, 1999 (NL) ..... 1011437

(51) Int. Cl.[7] ..... B21D 22/28
(52) U.S. Cl. ..... 72/349; 72/467
(58) Field of Search ..... 72/347, 349, 345, 72/348, 467, 379.2, 379.4

(56) References Cited

U.S. PATENT DOCUMENTS 3,930,396 A * 1/1976 Martinez ..... 72/347
3,951,296 A * 4/1976 Swanson et al. ..... 220/669
4,018,075 A 4/1977 Kawawa et al.
4,038,859 A * 8/1977 Pavleszek ..... 72/347
4,254,652 A 3/1981 Proctor
4,881,394 A * 11/1989 Jansen ..... 72/45
5,168,742 A * 12/1992 Heyes et al. ..... 72/379.4
5,782,375 A * 7/1998 McHenry et al. ..... 220/62.12
6,044,676 A * 4/2000 Sun ..... 72/45
6,098,892 A * 8/2000 Peoples, Jr. ..... 235/494

FOREIGN PATENT DOCUMENTS

EP 298560 1/1989
EP 0 298 560 A2 * 11/1989
WO WO94/22607 * 10/1994

OTHER PUBLICATIONS

H.C.E. van der Aa, "An experimental and numerical study of the wall ironing process of polymer coated sheet metal", Master Thesis Eindhoven University of Technology, Sep. 1998.

(List continued on next page.)

*Primary Examiner*—Lowell A. Larson
(74) *Attorney, Agent, or Firm*—Stevens, Davis, Miller & Mosher, LLP

(57) ABSTRACT

Process for the wall ironing of a product in sheet form, which is formed from a metal sheet coated on at least one side with a layer of plastic, the wall-ironing tool comprising a forming surface which the product with a plastic coating layer moves along during the wall ironing, and the forming surface being at an entry angle with respect to the direction of movement of the product, whereby the entry angle varies over the length of the forming surface, in the direction of movement of the product past the forming surface, this entry being smaller in a starting zone of the forming surface than in the subsequent zone thereof.

26 Claims, 2 Drawing Sheets

OTHER PUBLICATIONS

A.W. Christiansen et al., "The mechanical properties of polymers under high pressure", in Phil. Mag. vol. 24 (1971) 451–467.

N.V. Reddy et al., "Die design for axisymmetric extrusion" in Journal of Materials Processing Technology, vol. 55 (1995) 331–339.

B. Stok and A. Mihelic, "Optimal design of the die shape using nonlinear finite element analysis", in Simulation of Materials Processing: Theory, Methods & Applications (1995) pp. 625–630.

B. Stok and A Mihelic, "Optimal design of the die shape using nonlinear finite element analysis" Simulation of Materials Processing: Theory Methods and Applications (1995) pp. 625–630.

* cited by examiner

PROCESS FOR THE WALL IRONING OF A PRODUCT IN SHEET FORM, AND A WALL IRONING TOOL

This application claims priority of PCT Application PCT/EP00/01950 filed Mar. 2, 2000 and Netherlands Application 1011437 filled Mar. 3, 1999.

FIELD OF THE INVENTION

The invention relates to a process for the wall ironing of a product in sheet form, which is formed from a metal sheet coated on at least one side with a layer of plastic, the wall-ironing tool comprising a forming surface which the product with a plastic coating layer moves along during the wall ironing, and the forming surface being at an entry angle with respect to the direction of movement of the product. A process of this nature is in widespread use for the production of a can comprising a base and a tubular body, although the invention is not limited to this particular application.

BACKGROUND OF THE INVENTION

The entry angle forms an important parameter in wall ironing. It has been found that with a very small entry angle the spreading force, that is to say the force which acts on the forming surface transversely with respect to the direction of movement of the product, becomes very high. For example, in the case of wall ironing of cans, this may lead to extreme loads being imposed on the wall-ironing ring used, which may consequently be damaged or even break.

Selecting a larger entry angle runs the risk of the plastic layer breaking and being stripped off the metal sheet This is because a larger entry angle results in a greater longitudinal force being exerted on the plastic layer in the direction of movement, with the result that the stress in the said plastic layer exceeds a fracture limit.

Proposals have previously been made for making the process more suitable for working with plastic-coated metal sheet. In European Patent EP 0,298,560, it is proposed that additional lubrication be used during the wall ironing, and specific entry angles are proposed for successive wall-ironing rings. Nevertheless, there is a continuing need to work with larger entry angles, in order to be able to achieve longer service lives of the wall-ironing tool. The present invention now offers a solution enabling the risk of the plastic layer breaking and being stripped off during wall ironing to be reduced, so that larger entry angles can be used.

BRIEF DESCRIPTION OF THE FIGURES

The invention is based on making use of the observed fact that many plastics materials exhibit a higher fracture limit during forming as the pressure on all sides increases. FIG. 1 shows results of the correlation between the forming rate ($d\epsilon/dt$ in $sec^{-1}$), plotted on the horizontal axis, and the yield stress ⑨$_y$ in MPa, plotted on the vertical axis, and the prevailing pressure $P_o$ in MPa on all sides. This figure works on the basis of a polyethyleneterephthalate (PET), with lines illustrating results of model studies and crosses indicating the results of experiments. It can be clearly seen from this figure that the yield stress is considerably higher as the pressure on all sides rises. The object of the invention is therefore to produce a high pressure on all sides at the location where the coated metal sheet is being wall-ironed using a large entry angle, without it being necessary to apply a very high pressure to the entire wall-ironing installation.

DETAILED DESCRIPTION OF THE PREFERRED EMBODIMENTS

Figure 1:
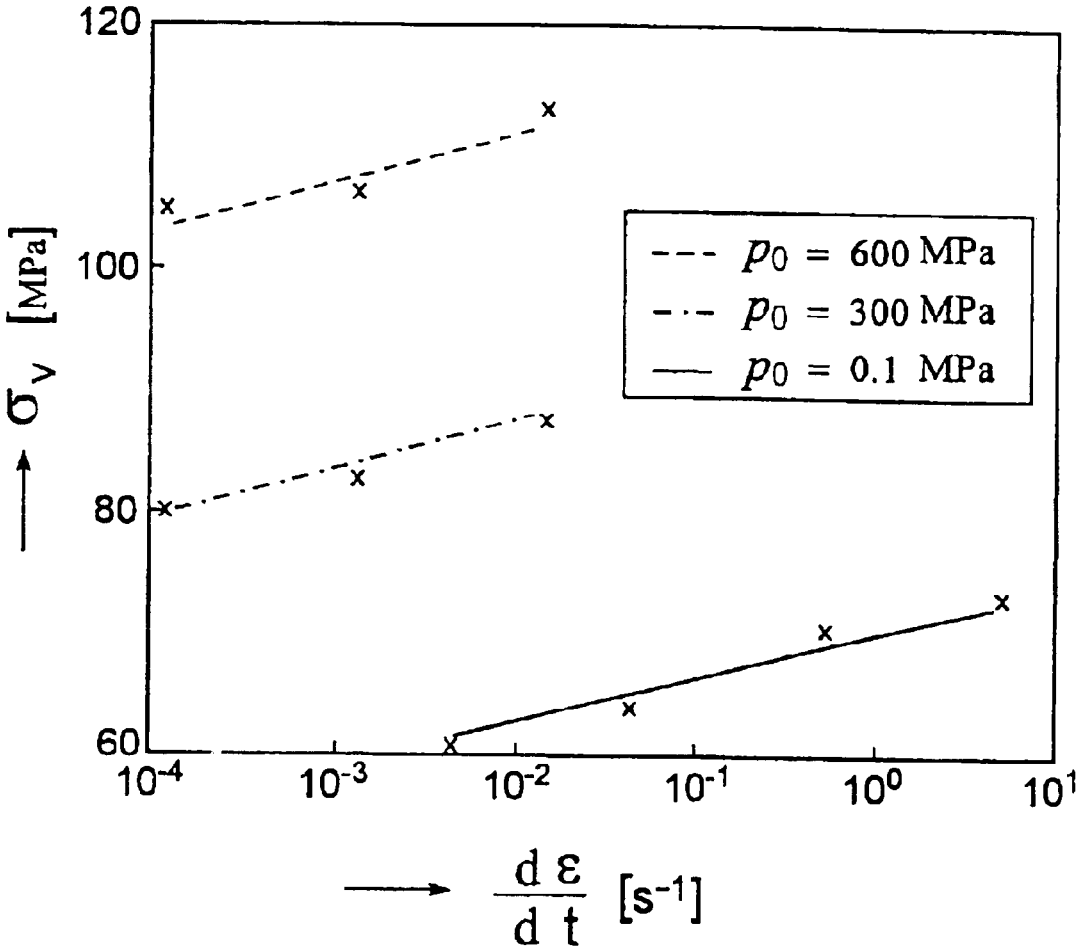
FIG. 1 shows results of the correlation between the forming rate (ds/dt in $s^{-1}$), plotted on the horizontal axis, and yield stress $\sigma_y$ in MPa, plotted on the vertical axis, and the prevailing pressure $P_o$ in MPa on all sides.
Figure 2:
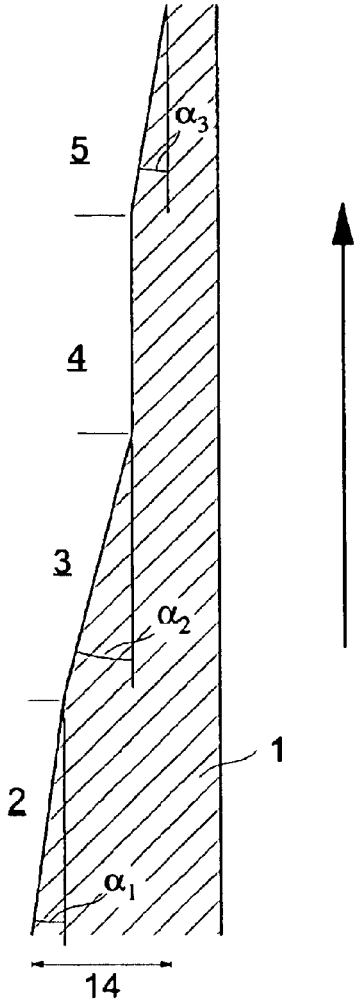
FIG. 2 is a schematic representation of the forming surface of a wall-ironing tool in accordance with a first embodiment of the invention.

The invention therefore consists in the fact that the entry angle varies over the length of the forming surface, in the direction of movement of the product (shown by an arrow in FIGS. 2–4) past the forming surface. FIG. 2 shows a product 1 being formed by contact with a forming surface of a wall ironing tool. For this forming surface, the entry angle $\alpha_1$ is smaller in a starting zone 2 of the forming surface than the entry angle $\alpha_2$ in the subsequent zone 3 thereof. The result of this measure is that, in the starting zone 2 with the small entry angle $\alpha_1$, a high pressure on all sides is built up in the material, and this pressure is maintained during the subsequent forming in the subsequent zone 3 with a the larger entry angle $\alpha_2$. In the zone where the actual forming takes place, a high pressure prevails on all sides, yet nevertheless a relatively low spreading force is exerted on the forming surface (for example a wall-ironing ring).

The high pressure which is generated on all sides in the plastic layer may relax slightly towards the chamber after the wall-ironing tool has been passed, towards the end of the zone 3 with the larger entry angle $\alpha_2$. This may mean that the fracture stress of the plastic material is reduced again at that location, causing it to fracture and be stripped off by the wall-ironing tool. For this reason, it has proven advantageous for the forming surface in an end zone 5 to again be at a smaller entry angle $\alpha_3$ than in the intermediate zone 3.

An improvement is also achieved if the forming surface, following the zone 3 with the largest entry angle $\alpha_2$, comprises a so-called land zone 4, with an entry angle of 0. The length of this land zone 4 may be between 0.3 and 1.5 mm.

Figure 3:
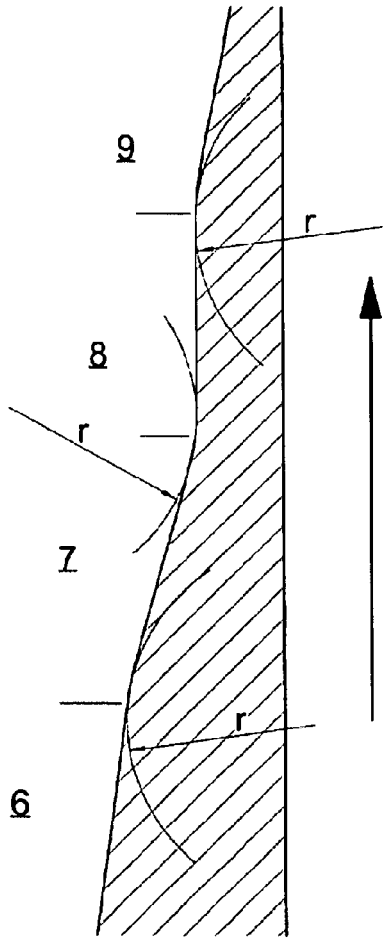
FIG. 3 is a schematic representation of a forming surface in accordance with a second embodiment of the invention.

In one possible application of the invention, the entry angle may have a fixed value in each of the zones 2, 3, 4 and 5 as shown in FIG. 2. However, under certain circumstances it may be preferable for the entry angle to change smoothly over the length of the forming surface as shown in FIG. 3 over zones 6, 7, 8 and 9 which correspond to zones 2, 3, 4 and 5 of FIG. 2. This prevents sudden changes in stress in the material to be wall ironed, so that, under certain circumstances, the wall ironing can proceed more successively.

In the preferred embodiment of this smooth change, the transitions between the successive zones, and/or the zones themselves, run in the form of an arc of a circle as shown in FIG. 3. Good results are obtained if the radius "r" of this arc is between 0.1 and 10 mm long.

Figure 4:
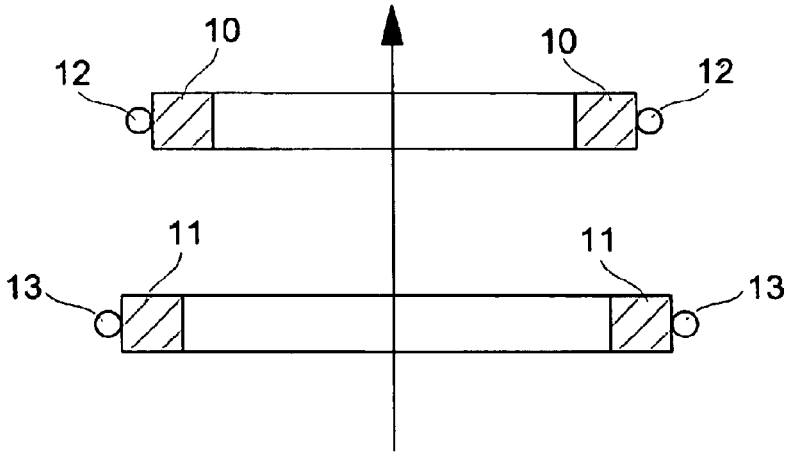
FIG. 4 is a schematic presentation of a cross section through a wall-ironing tool in accordance with the invention.

Particularly if the novel process is used for the wall ironing of a product which ultimately acquires the shape of a can, it is advantageous for the wall-ironing tool to comprise a plurality of wall-ironing rings 10, 11 as shown in FIG. 4, each ring 10, 11 having a forming surface of the type described above. In particular, it has proven advantageous for between 60 and 90% of the total wall thinning to be produced by the corresponding forming surface in the zone which runs at the largest entry angle, the so-called main zone. A further improvement is obtained if between 10 and 30% of the total wall thinning is produced by the corresponding forming surface in the starting zone. Furthermore, it is advantageous, if an end zone is also being used, for less than 30% of the total wall thinning to be produced by the corresponding forming surface in this end zone.

As explained above, it is possible, when using the novel process according to the invention, to use a larger entry angle in particular in the intermediate main zone, allowing the mechanical load on the forming surface, i.e. the wall-ironing ring, to be reduced. Despite this larger entry angle, it is generally possible, by using a starting zone and an end zone with a smaller entry angle, to prevent the plastic coating layer from yielding and being stripped off.

When using various plastics in various layer thicknesses and on various types and thicknesses of metal sheet, the limiting conditions for the entry angle in the intermediate zone and the entry angle and the length of the starting zone and the end zone will generally be different if it is desired to work using conditions which are optimal for all ironing without there being any risk of the plastic layer fracturing and being stripped off. It has been found that for various materials applications, the optimum conditions can be determined by means of experiments using forming surfaces (for example of wall-ironing rings) in which the length of the starting zone and/or the end zone is varied.

During the wall ironing of a plastic-coated metal sheet, the following functional relationship applies to the yield stress $\sigma_v$ (in MPa) in the plastic:

$$\sigma_v = \frac{3}{\sqrt{3+\mu}} \cdot \left[\tau_0 \ln\left(2\sqrt{3} \cdot A_0 \cdot d\varepsilon/dt\right) + \mu P_0\right],$$

where:

- $P_0$ is the pressure in MPa prevailing on all sides in the plastic;
- $\tau_0$ is a base level for the yield stress in MPa;
- $d\epsilon/dt$ is the drawing speed of the plastic being formed in $sec^{-1}$;
- $\mu$ is a unit-free parameter which represents the pressure sensitivity of the plastic;
- $A_0$ represents a time constant (in sec) which is related to the relaxation behaviour of the plastic.

According to the invention, it has been found that the wall ironing of a coated product in sheet form at an elevated pressure on all sides $P_0$ only takes place successively if the values of the parameters $\mu$, $\tau_0$ and $A_0$ of the plastic used for the coating satisfy specific boundary conditions. These values must be as follows:

$$\mu \geqq \mathbf{0.03};\ \tau_0 \geqq 0.60 \text{ MPa and } A_0 \geqq 2.0\times10^{19} \text{ sec.}$$

It is preferable to use plastics in which the parameters are as follows:

$$\mu \geqq 0.047;\ \tau_0 \geqq 0.90 \text{ MPa and } A_0 \geqq 3.0\times10^{19} \text{ sec.}$$

It has been found that what is known as the glass transition temperature $T_g$ of the plastic is important in the wall ironing of a plastic-coated metal sheet. $T_g$ is the transition point for the properties of the amorphous range in the plastic. In principle, below $T_g$ free movement of the main chain of the polymer is impossible. Above $T_g$, this freedom of movement is possible, leading to the hardness of the material falling by orders of magnitude. Since many plastics are partially crystalline, and this part partially retains its strength up to the melting point, many plastics materials can still be used very well up to temperatures far above $T_g$.

In the case of wall ironing, the level of $T_g$ is important because the plastic must still have a relatively high mechanical strength during the wall ironing. A plastic coating with a low $T_g$ may possibly acquire sufficient strength by building up a very high pressure in the wall-ironing tool. However, just outside this pressure zone the plastic is so "weak" that it is immediately pressed away and scrapped off.

During the wall-ironing process, a considerable rise in temperature takes place in the ironed material. This temperature may rise to approx. 200° C.

It has been found that a plastic-coated metal sheet can be successfully wall-ironed if the $T_g$ of the plastic is sufficiently high under various conditions. The $T_g$ at atmospheric pressure, $T_{g,\ 1\ atm}$ and the $T_g$ when the plastic is under a pressure on all sides of 600 MPa, $T_{g,\ 600\ MPa}$, have proven particularly important in this context. According to the invention, $T_{g,\ 1\ atm}$ and $T_{g,\ 600\ MPa}$ must be as follows: $T_{g,\ 1\ atm} \geqq 30°$ C. and $T_{g,\ 600\ MPa} \geqq 200°$ C. Preferably, $T_{g,\ 1\ atm}$ must be as follows: $T_{g,\ 1\ atm} \geqq 70°$ C.

In addition to the process described above, the invention also relates to a wall-ironing tool, in particular a wall-ironing ring, comprising a forming surface, past which a sheet-like product can be moved during the wall ironing, which forming surface is at an entry angle with respect to the direction of movement of the product. This wall-ironing tool is characterized in that the entry angle varies over the length of the forming surface, in the direction of movement of the product, this angle being smaller in a starting zone of the forming surface than in the subsequent zone thereof.

Numerous preferred embodiments of the wall-ironing tool according to the invention have been explained in the preceding description of the novel process, to which reference is made here.

FIG. 2 is a schematic representation of the forming surface of a wall-ironing ring based of the invention. Number 1 denotes the product. The arrow shows the direction of movement of the product and $\alpha_1$, $\alpha_2$, and $\alpha_3$ denote entry angles. The term entry angle is defined as the angle of the forming surface with respect to the direction of movement of the product. Number 2 denotes the starting zone of the forming surface. The starting zone, has a smaller entry angle than in the subsequent intermediate or main zone denoted by number 3. In accordance with this description $\alpha_1$ is smaller than $\alpha_2$ in the figure.

Number 4 denotes the land zone, which follows the zone with the largest entry angle. The land zone has an entry angle of 0°. Number 5 denotes the end zone, and has a smaller entry angle than in the intermediate zone 3. The entry angle, herein, has a fixed value in each of the zones. Number 14 denotes the transverse dimension of the forming surface (transverse with respect to its longitudinal direction).

FIG. 3 is a schematic representation of the forming surface of a wall-ironing tool which has a starting zone 6, an intermediate or main zone 7, a land zone 8 and an end zone 9 where the entry angles change smoothly over the length of the forming surface.

A particular preferred embodiment of a wall-ironing ring according to the invention is also that this wall-ironing ring is under a radial prestress on its outer circumferential surface, due to a strip or wire which has been wound around it under stress. FIG. 4 is a schematic representation of a cross section through a wall ironing tool comprising two wall-ironing rings 10, 11 of the type described above. Each wall ironing ring 10, 11 being under a radial prestress on its outer circumferential surface due to a strip or wire 12, 13 wound around it under stress. The arrow in FIG. 4 shows the direction of movement of the product through the tool.

Wall-ironing rings are generally known, as are the associated terms such as entry angle, main zone and land zone.

Therefore, there is no need for the wall-ironing rings discussed to be explained in more detail in a description referring to figures.

What is claimed is:

1. Process for the wall ironing of a product in sheet form, which is formed from a metal sheet coated on at least one side with a layer of plastic, comprising moving the product with a plastic coating layer in a direction of movement along a forming surface of a wall-ironing tool during the wall ironing, the forming surface comprising a plurality of zones along a length of the forming surface, each zone being at an entry angle with respect to the direction of movement of the product, the plurality of zones comprising a starting zone and a subsequent zone, the product moving along the starting zone and subsequently moving along the subsequent zone, wherein the entry angle varies over the length of the forming surface, in the direction of movement of the product past the forming surface, this entry angle being smaller in the starting zone of the forming surface than in the subsequent zone of the forming surface.

2. Process according to claim 1, wherein after moving along the subsequent zone the product moves along an end zone of the forming surface, wherein the entry angle in the end zone is smaller than in the subsequent zone.

3. Process according to claim 2, wherein the entry angle of each zone has a fixed value.

4. Process according to claim 2, wherein there is a smooth change in the entry angle over the length of the forming surface.

5. Process according to claim 4, wherein the forming surface further comprises transitions between successive zones, and/or such zones themselves which run in the form of an arc of a circle.

6. Process according to claim 1, wherein one zone of said plurality of zones has a largest entry angle relative to other said zones and the forming surface, following the one zone with the largest entry angle, comprises a land zone with an entry angle=0°.

7. Process according to claim 6, wherein the moving step thins walls of the product, and 60 to 90% of total wall thinning is produced by the one zone having the largest entry angle.

8. Process according to claim 7, wherein 10 to 30% of the total wall thinning is produced by the corresponding forming surface in the starting zone.

9. Process according to claim 7, wherein after moving along the subsequent zone the product moves along an end zone of the forming surface, wherein the entry angle in the end zone is smaller than in the subsequent zone, wherein less than 30% of the total wall thinning is produced by the corresponding forming surface in the end zone.

10. Process according to claim 1, wherein the wall-ironing tool comprises a plurality of forming surfaces.

11. Process according to claim 1, wherein the wall-ironing tool comprises a plurality of wall-ironing rings.

12. Process according to claim 1, wherein after moving along the subsequent zone the product moves along an end zone of the forming surface, wherein a length of the starting zone and/or a length of the end zone, under otherwise identical conditions, is set in such a way that the plastic coating is not torn off the metal sheet as a result of the wall ironing.

13. Process according to claim 1, wherein in the subsequent zone of the forming surface is a zone of the forming surface which runs at the largest entry angle and, in the subsequent zone the plastic layer is held under an elevated pressure $P_0$ (in MPa) on all sides, and the plastic used for the coating layer is characterized by values of the parameters $\mu$ (no units); $\tau_0$ (in MPa) and $A_0$ (in sec), which are as follows: $\mu \geqq 0.03$; $\tau_0 \geqq 0.60$ and $A_0 \geqq 2.0\times10^{19}$.

14. Process according to claim 13, wherein the parameters $\mu$, $\tau_0$ and $A_0$ are as follows: $\mu \geqq 0.047$; $\tau_0 \geqq 0.90$ and $A_0 \geqq 3.0\times10^{19}$.

15. Process according to claim 13, wherein the plastic used is also characterized by values for the parameters $T_{g,\ 1\ atm}$ and $T_{g,\ 600\ MPa}$ (in ° C.) which are as follows: $T_{g,\ 1\ atm} \geqq 30°$ C., and $T_{g,\ 600\ MPa} \geqq 200°$ C.

16. Process according to claim 13, wherein the parameter $T_{g,\ 1\ atm}$ is as follows: $T_{g,\ 1\ atm} \geqq 70°$ C.

17. Wall-ironing tool comprising a wall-ironing ring, comprising a forming surface, along which a sheet-like product is movable in a direction of movement during the wall ironing, the forming surface comprising a plurality of zones along a length of the forming surface, the plurality of zones comprising a starting zone and a subsequent zone downstream of the starting zone with respect to the direction of movement of the sheet-like product, each zone being at an entry angle with respect to the direction of movement of the product, wherein the entry angle varies over the length of the forming surface, in the direction of movement of the product, this angle being smaller in the starting zone of the forming surface than in the subsequent zone of the forming surface.

18. Wall-ironing tool according to claim 17, wherein the plurality of zones of the forming surface further comprises an end zone downstream of the subsequent zone with respect to the direction of movement of the sheet-like product, the end zone having a smaller entry angle than the subsequent zone.

19. Wall-ironing tool according to claim 17, wherein the plurality of zones of the forming surface further comprises an end zone downstream of the subsequent zone with respect to the direction of movement of the sheet-like product, and between the subsequent zone and the end zone there is a land zone with a length of between 0.3 and 1.5 mm.

20. Wall-ironing tool according to claim 17, wherein the entry angle has a fixed value in each zone of the plurality of zones.

21. Wall-ironing tool according to claim 17, wherein there is a smooth change in the entry angle over the length of the forming surface.

22. Wall-ironing tool according to claim 21, wherein transitions between successive zones of the plurality of zones, and/or the zones themselves, run in the form of an arc of a circle with a radius of a length of between 0.1 and 10 mm.

23. Wall-ironing tool according to claim 17, wherein the zone of the plurality of zones having the largest entry angle, which is named a main zone, forms between 60 and 90% of the transverse dimension of the forming surface, transversely with respect to its longitudinal direction.

24. Wall-ironing tool according to claim 23, wherein the starting zone forms between 10 and 30% of the transverse dimension of the forming surface.

25. Wall-ironing tool according to claim 23, the plurality of zones further comprising an end zone downstream of the subsequent zone with respect to the direction of movement of the sheet-like product, wherein the end zone forms less than 30% of the transverse dimension of the forming surface.

26. Wall-ironing tool in the form of a wall-ironing ring, according to claim 17, wherein this wall-ironing ring is under a radial prestress on its outer circumferential surface, due to a strip or wire which has been wound around the ring under stress.

* * * * *